United States Patent [19]

Blanchard

[11] 4,357,820

[45] Nov. 9, 1982

[54] SAFETY CONTROL SYSTEM FOR METAL FORMING MACHINE

[75] Inventor: Gary N. Blanchard, Pocatello, Id.

[73] Assignee: Bangor Punta Corporation, Greenwich, Conn.

[21] Appl. No.: 113,851

[22] Filed: Jan. 21, 1980

[51] Int. Cl.[3] ..... B21D 55/00

[52] U.S. Cl. ..... 72/389; 72/26; 72/444; 192/129 A; 192/130

[58] Field of Search ..... 72/444, 389, 26, 3, 72/4, 10, 25; 192/129 A, 130

[56] References Cited

U.S. PATENT DOCUMENTS

| | | | |
|---|---|---|---|
| 1,962,742 | 6/1934 | Jongedyk | 192/129 A |
| 2,241,556 | 5/1941 | MacMillin | 192/130 |
| 2,456,749 | 12/1948 | Steibel | 72/412 |
| 2,797,583 | 7/1957 | Jeszka | 192/130 |
| 4,166,369 | 9/1979 | Nakajima | 72/389 |

*Primary Examiner*—Gene Crosby
*Attorney, Agent, or Firm*—Patrick J. Walsh

[57] ABSTRACT

A safety control system for a metal forming machine having a vertically moving forming ram which cooperates with a stationary forming die for forming a variety of creases in sheet metal manipulated by an operator. The safety control system returns the forming ram to an inactive position in the event the operator inadvertently positions tool or limb between ram and die during machine operation.

5 Claims, 3 Drawing Figures

14
88
OVERRIDE SWITCH
22
80
86
78
76
24
24
58
72
70
V
DUMP VALVE
CONTROL VALVE
56
66
FILTER
V
C
K
60
OIL TANK
62
V
64
BY PASS VALVE
50
P
52
51
54
M
7
8
1
2
6
5
4
3
74
84
7
8
1
2
6
5
4
3
82
1
2
91
92
90

SAFETY CONTROL SYSTEM FOR METAL FORMING MACHINE

BACKGROUND OF THE INVENTION

The present invention relates to apparatus for forming material, such as metal, and particularly relates to a safety control system for a metal bending or forming machine having a relatively movable die and head for forming metal therebetween wherein the safety control system is operable to disable the machine in the event an obstruction, other than the metal being formed, is located between the die and head.

Many different types of material forming machines, e.g., metal bending or forming machines, have been proposed and constructed in the past. Generally, these machines have the capability to perform various metal bending operations, such as forming and hemming. One such metal bending or forming machine, which is the subject of U.S. Pat. No. 2,456,749, has an elongated, generally cylindrical, lower die rotatably carried by a frame. The die has a plurality of elongated bending or forming grooves spaced one from the other about its periphery. Disposed above the lower die and movable vertically on the frame toward and away from the die is a head. The head carries an upper die or forming member along its lower edge in spaced relation to the lower rotatable die.

In use, the lower die is indexed into a rotary position with a selected one of its grooves in confronting spaced relation to the upper die or forming member. Upon disposition of material, e.g., metal, between the upper and lower dies, hydraulic cylinders are actuated to move the head, and consequently the upper die, toward the lower die to accomplish the selected forming operation on the metal between the dies. Once the material is formed, the hydraulic pressure is relieved and return springs displace the upper head and forming member away from the lower rotatable die to return the head to its initial or rest position.

While machines of this type have proved remarkably well suited for accomplishing various forming operations, the material to be formed is usually manually located in the gap between the upper and lower dies by the machine operator. This exposes the machine operator to serious injury. For example, when locating the metal in the machine, the operator may obstruct the machine by locating one or both of his arms or hands, or his finers between the upper and lower dies. If the machine is inadvertently actuated at that time, injury to the machine operator including loss of one or more hands, arms, or fingers may result. Other types of obstructions may also be inadvertently located between the upper and lower dies during forming operations. For example, tools or jigs may accidentally be located in the gap between the dies. Actuation of the machine under those circumstances could damage either or both of the upper and lower dies and possibly also injure the machine operator. Consequently, there is a demonstrable need, in material forming apparatus of this type, for a safety control system operable to disable the machine or render it inoperable in the event an obstruction, other than the material to be formed, is located between the working members of the machine.

SUMMARY OF THE INVENTION

Accordingly, it is a primary object of the present invention to provide a material forming apparatus, e.g., a metal forming machine of the type having a relatively movable die and forming member, and including a safety control system which automatically disables the apparatus from forming operations upon detection of an obstruction, other than the material being formed, between the die and the forming member.

It is another object of the present invention to provide a material forming apparatus, e.g., a metal forming machine, having the foregoing characteristics wherein the safety control systems automatically returns the machine to its initial or rest position in the event an obstruction, other than the material being formed, is sensed in the gap between the die and the forming member.

It is a further object of the invention to provide a material forming apparatus, e.g., a metal forming machine, having the foregoing characteristics wherein the safety control system disables the machine from forming operations upon detection of an obstruction, other than the material being formed, between the die and the forming member through a first discrete range of relative movement of the die and forming member and enables the machine automatically to continue the forming operation after the die and forming member have relatively moved beyond the first discrete range of relative movement.

It is a related object of the present invention to provide a material forming apparatus, e.g., a material forming machine, having the foregoing characteristics wherein the safety control system includes a sensor disposed to detect the presence of an obstruction in the path of relative movement of the die and the forming member and control circuitry which requires actuation of the sensor before any relative movement of the die and the forming member can be effected.

Additional objects and advantages of the present invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purposes of the present invention, as embodied and broadly described herein, a machine for forming material in accordance with the present invention may comprise a frame, a bed carried by the frame, a first die carried by the bed, a head carried by the frame, a second die carried by the head, means carried by the frame for relatively moving the bed and the head toward and away from one another between a first position with the dies spaced one from the other for receiving material to be formed therebetween and a second position with the die in close proximity one to the other with the formed material therebetween, means for sensing an obstruction between the dies, other than the material being formed, and providing a signal in response thereto, and means responsive to the signal and arranged in controlling relation to the moving means for preventing relative movement of the dies toward the second position when an obstruction is disposed between the dies.

Thus, in accordance with this invention, the material forming operation is completely stopped in the event an obstruction, other than the material being formed, is located in the gap between the dies. In accordance with a further aspect of this invention, the machine is then automatically returned to its rest position locating the dies in their extreme positions spaced a maximum distance one from the other. This advantageously enables the immediate withdrawal of the obstruction from between the dies.

The invention consists in the novel parts, constructions, arrangements, combinations, and improvements shown and described. The accompanying drawings, which are incorporated in and constitute a part of this specification, illustrate one embodiment of the invention and, together with the description, serve to explain the principles of the invention.

BRIEF DESCRIPTION OF THE DRAWING FIGURES

Reference will now be made in detail to the present preferred embodiment of the invention, an example of which is illustrated in the accompanying drawing Figures.

Figure 1:
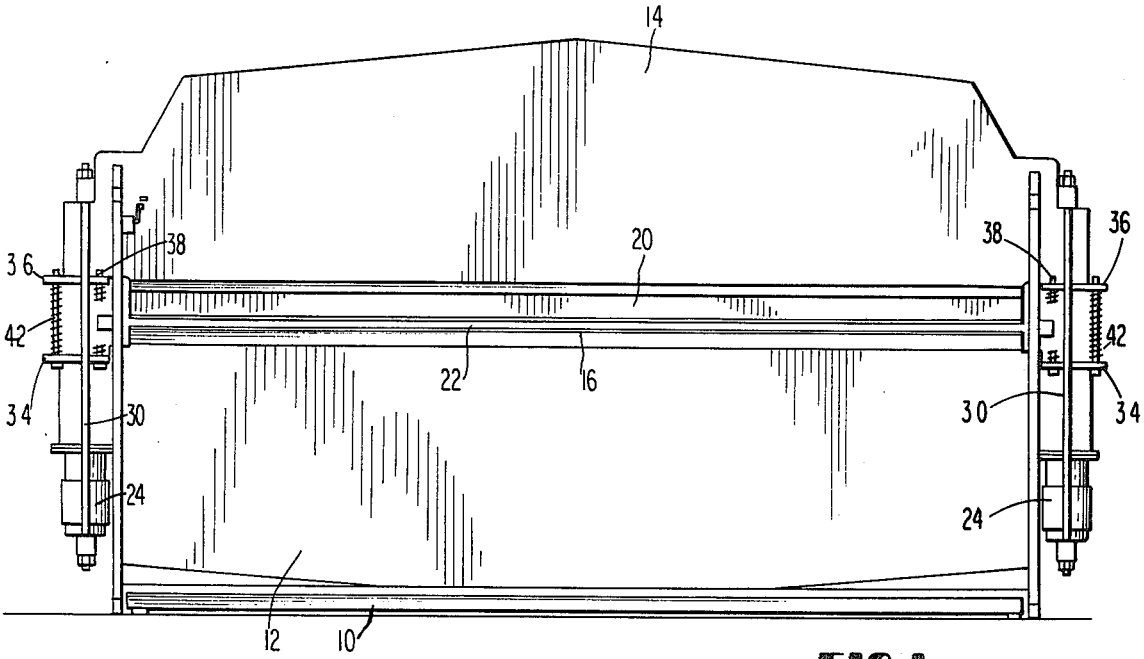
FIG. 1 is a front elevational view of a material forming apparatus constructed in accordance with the present invention.
Figure 2:
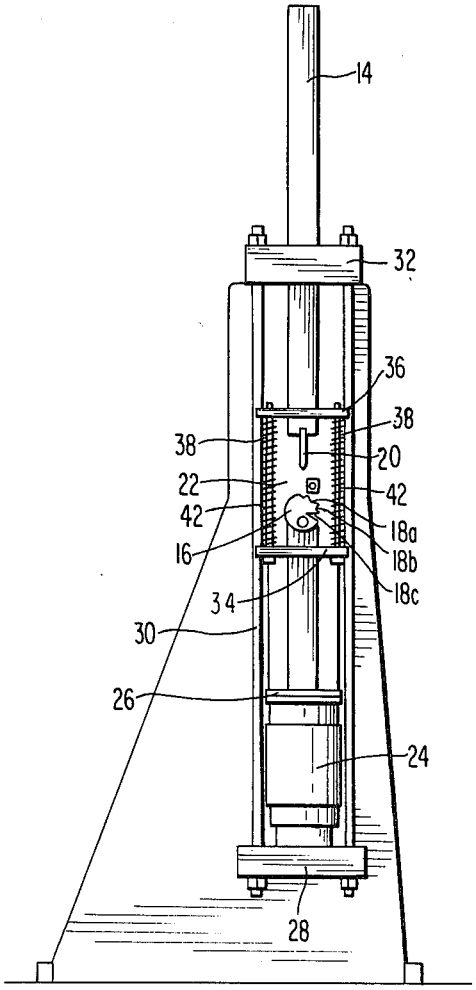
FIG. 2 is an enlarged side elevational view thereof.

Referring now to FIGS. 1 and 2, a material forming apparatus incorporating the safety control system hereof, and constructed in accordance with the present invention, may comprise a frame, generally indicated 10, having a lower bed or base 12, and an upper head or ram 14. Rotatably carried by bed 12 along its upper edge and in opposition to ram 14 is an elongated die 16. Die 16 carries a plurality of grooves or openings 18*a*, 18*b*, 18*c*, etc. (FIG. 2) circumferentially spaced one from the other about the die. A forming member or upper die 20 is carried along the lower edge of ram 14 in opposition to die 16. Grooves or openings 18*a*, 18*b*, 18*c*, etc., comprise discrete die openings for accomplishing specific bending or forming operations in cooperation with upper die 20. Die 16 is rotatable by a lever, not shown, at one end of the machine such that the selected die opening or groove 18*a*, 18*b*, 18*c*, etc., in lower die 16 may be accurately aligned with upper die 20. Positive alinement of the dies is assured by an automatic detent device, also not shown.

It will be appreciated that in the illustrated normal or rest position of the forming apparatus thereof, a gap or space 22 is provided between the lower die 16 and the upper die 20. Gap 22 permits insertion and proper positioning of the work, e.g., metal, between the upper and lower dies prior to commencing the forming operation.

Means are carried by frame 10 for relatively moving the bed and head toward and away from one another between a first position with upper and lower dies 20 and 16 respectively, spaced one from the other for receiving material to be formed therebetween and a second position with the dies in close proximity one to the other with the formed material therebetween. From this, it will be appreciated that both the head and bed may be movable toward and away from one another, that the bed with the rotatable die may be movable toward and away from a stationary head or ram or that the head or ram may be movable toward and away from a stationary bed. In the preferred embodiment of the present invention and as will be appreciated from the ensuing description, the head or ram 14 is movable toward and away from the stationary bed 12.

In such preferred embodiment, suitable guides are provided at opposite ends of the frame enabling sliding movement of the head or ram toward and away from the lower bed. Preferrably, the above mentioned means includes, at each of the opposite ends of the frame, a single acting, spring returned, hydraulic cylinder 24. The upper end of each cylinder 24 is suitably secured to a support bracket 26 fixed to frame 10. The piston of each cylinder 24 carries a pivot block 28 for extension and retraction therewith upon respective actuation and spring return of hydraulic cylinder 24. A pair of tie rods 30 are provided at each end of machine 10. The lower ends of each pair of tie rods 30 are secured to pivot block 28 while the upper ends of tie rods 30 are secured to a block 32, for example, by suitable lock nuts. Block 32 is, in turn, suitably secured to head or ram 14. It will be appreciated that actuation of hydraulic cylinders 24 extends the respective pistons in a downward direction and thus carries the pivot blocks 28, tie rods 30, blocks 32 and head or ram 14 downwardly therewith from the first or rest position illustrated in FIG. 2 toward a second position with lower die 16 and upper die 20 in close proximity one to the other with the material formed therebetween.

Means are provided for retaining the lower and upper dies 16 and 20 respectively in such first or rest position prior to commencement of a forming operation and to automatically relatively return the dies to such first position after a forming operation is complete or in the event an obstruction, other than the material to be formed, is sensed in gap 22 in the path of relative movement of the dies. Preferrably, such means includes, at each end of the apparatus, lower and upper support plates 34 and 36 respectively fixed to bed 12 and head or ram 14. Secured at their lower ends to plates 34 are a plurality of upstanding guide rods 38. The upper ends of guide rods 38 are slideably received in openings formed in the upper plates 36 fixed to head or ram 14. Helical coil or ram return springs 42 are disposed about rods 38 and bias the upper plates and consequently ram 14 for movement in an upward direction toward the machine rest or first position. Suitable stops, not shown, are carried by frame 10 to limit the extent of upward movement of ram 14 relative to bed 12.

When work, e.g., metal to be formed, is disposed between the dies in gap 22 and accurately aligned relative to the dies, it will be appreciated that actuation of hydraulic cylinders 24 causes the ram or head 14 to be drawn downwardly toward bed 12 against the bias of return springs 42. Thus, the upper and lower dies close the gap 22 therebetween and cooperate to form the material therebetween in accordance with the particular die groove 18 selected. Once the work is formed, hydraulic pressure is relieved, by means described hereinafter, and springs 42 displace ram 14 in an upward direction for return to its first or rest position against the movement limit stops, not shown.

From the foregoing description, it will be readily apparent that obstructions, other than the material being formed, may be disposed between the upper and lower dies when the machine is at rest or during movement of the ram toward the head during forming operations. Such obstructions may comprise tools, jigs or other objects as well as one or more of the upper extremities of the machine operator. Obviously, the interposition of such obstructions in gap 22 in the path of relative movement of the dies may cause injury to the operator and/or damage to the machine.

In accordance with the present invention, there is provided a safety control system including and electrical-hydraulic control circuit for arresting the relative movement of the head and bed from the first or rest position toward the second or forming position and automatically relatively returning the ram and bed to the rest position in response to sensing or detecting an obstruction, other than the material to be formed, in gap 22. To accomplish this and referring particularly to FIG. 3, the circuit includes a source 50 of hydraulic fluid, a pump 52 in communication with hydraulic fluid from source 50 by a conduit 51, and electric motor 54 for driving pump 52, and a two way, three position, manually operated, spring returned, control valve 56 for communicating hydraulic fluid from pump 52 via a conduit 58 to the upper ends of cylinders 24. A check valve 60 is also disposed in conduit 58 upstream of control valve 56. A conduit 62 communicates between the downstream side of pump 52 and source 50. A normally open, solenoid actuated, bypass valve 64 is located in conduit 62 downstream of conduit 58 whereby, upon actuation of pump 52, hydraulic fluid is normally recirculated in a closed loop from and to source 50, through pump 52, and valve 64 via conduits 51 and 62. A conduit 66 is provided and communicates between source 50 and control valve 56. A conduit 70 is also provided and communicates between conduit 58 on the downstream side of control valve 56 and source 50. A normally open, solenoid actuated, dump valve is provided in conduit 70. Thus, the fluid pressure in cylinders 24 and conduit 58 downstream of control valve 56 is normally relieved by the free communication between cylinders 24 and fluid source 50 by way of conduits 58 and 70 and dump valve 72.

In the rest position of control valve 56, fluid in conduit 51 is returned to source 50 by way of conduit 66. In a second position of control valve 56, fluid communication through valve 56 is blocked. In a third position of valve 56, pressure fluid from pump 52 communicates through valve 56 and conduit 58 to cylinders 24. It will be appreciated that control valve 56 is manually operated by the machine operator, for example by a treadle, not shown. Consequently by actuating pump 52, closing both bypass valve 64 and dump valve 72, and shifting control valve 56 to communicate pressure fluid to cylinders 24, the ram may be displaced from its rest position toward its material forming position.

Figure 3:
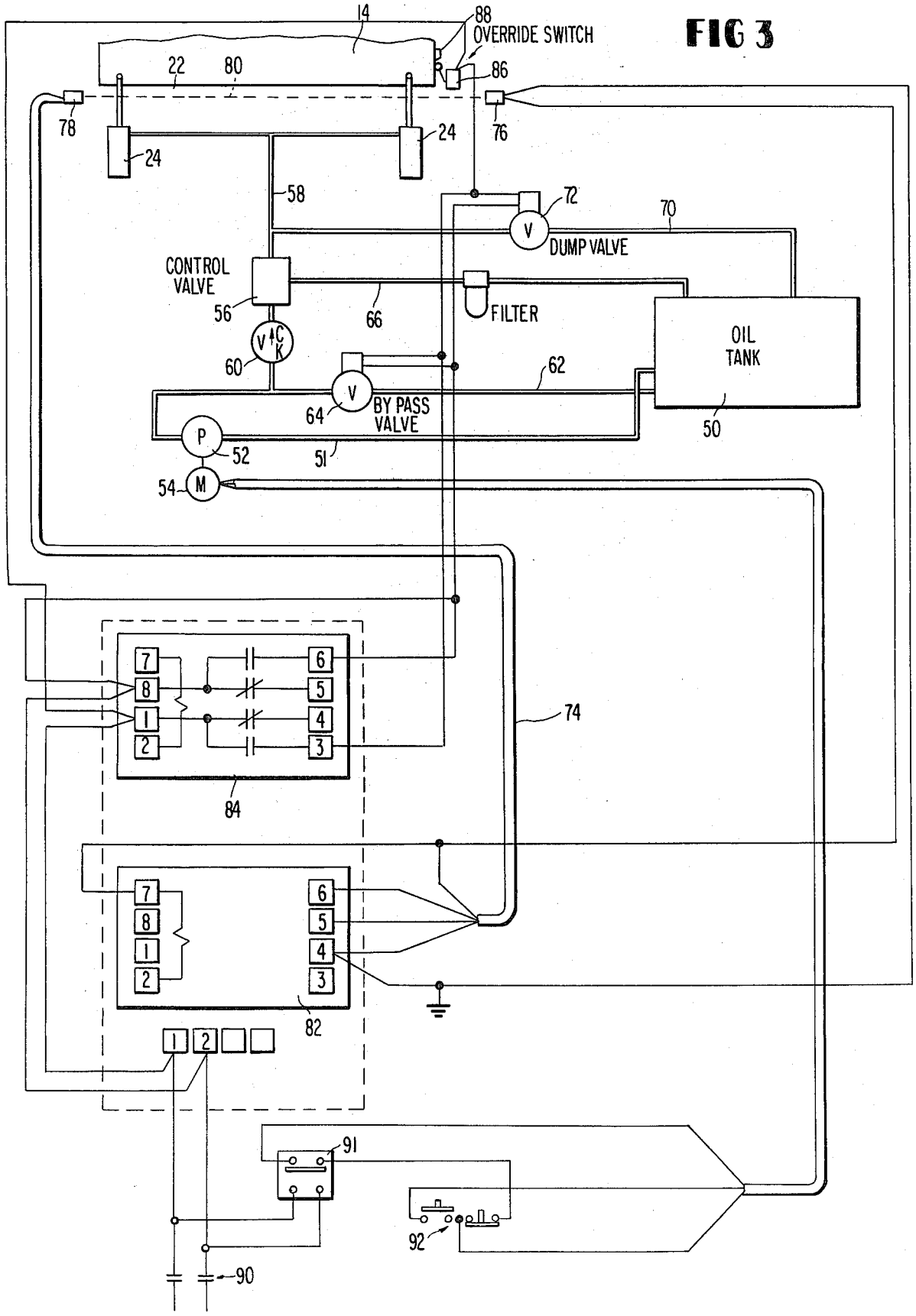
FIG. 3 is a combined electrical-hydraulic schematic of a safety control system forming part of the material forming apparatus hereof.

An electrical circuit 74 for safety control of the forming apparatus is shown in FIG. 3 and comprises a photocell light source 76 and sensor 78 which project a light beam 80 along a predetermined path in the gap 22 between the ram 14 and the die 16. Preferably, the beam is located a distance above the forming die greater than the thickness of work being handled and less than the height or vertical dimension of unwanted obstructions (tools, fingers, etc.) in the path of the descending ram. In a typical installation for bending sheet metal the beam may be located at a height of up to one-half inch above the die and preferably three eights of an inch above.

If the light beam 80 is interrupted while the ram is in the descending mode, that is, when hydraulic fluid under pressure flows to cylinders 24, electric power is interrupted to both normally open bypass valve 64 and normally open dump valve 72 so that pressurized fluid returns to the oil tank 50 through these valves and the ram immediately ascends to its up position under force of cylinder return springs 42.

The photoelectrical cells operate through a conventional photocell amplifier 82 and double throw-double pole relay 84 wired as shown in FIG. 3 for actuating the bypass valve and the dump valve. Conventional photoelectrical control components are available from General Electric Company under its MOD-U.-Ray trade designation.

The electric control system further includes an override switch 86 for the purpose overriding the action of the photoelectric system when the lower edge of the metal bending ram 14 has reached a predetermined distance from the bed of the die so that the work itself will not interfere with operation of the ram. The override switch 86 is actuated by a suitable cam 88 positioned on the ram in relationship to the switch so that, when the ram reaches the predetermined distance from the die, the switch overrides the action of the photoelectric system and maintains electric power to the solenoids of the bypass valve and of the dump valve.

In the electric circuit of FIG. 3, the safety system contains an interlock requiring action of the safety circuit before the hydraulic pump is actuated. Main line switch 90 when closed supplies electric power to photocell amplifier 82 and relay 84 which in turn energize the photoelectric circuit and the solenoid actuated bypass valve and dump valve. The main power supply to the main electric motor 54 is a lockout relay 91 and a motor start switch 92. With this arrangement, the electric motor 54 cannot be started without energizing the safety circuit 74. Moreover, should there be any failure to operate the safety circuit the normally open bypass and dump valves will simply return hydraulic fluid to the sump tank 50 and cylinder return springs 42 will return to the ram 14 to its rest position.

It should be understood that line voltage for the main motor circuit is 240 volts typically and would be stepped down by a suitable transformer (not shown) to 115 volts for the electric safety circuit 74.

In operation, main line switch 90 provides operating current to the safety control circuit 74 including photoelectric cells 76, 78 and the normally open solenoid actuated dump 72 and bypass 64 valves. As a further safety feature the motor starting circuit contains a lockout relay 91 which provides power to the motor circuit through motor starting switch 92 only when the safety circuit 74 is energized. In normal operation, hydraulic fluid moves the pistons of cylinders 24 downward to the operating position. As the ram approaches the photoelectric beam 80, the override switch 88 maintains current to the bypass 64 and dump 72 valves even though the ram itself intrudes into the path of the beam. That is, the ram continues its normal downward excursion to complete a particular metal bending operation. After release of the operating treadle, the ram returns to the upper position.

In the event an obstruction interrupts the photoelectric beam during descend of the ram, the control relay 84 will open cutting off power to the dump 72 and bypass 64 valves so that hydraulic fluid is returned to the sump tank 50 and the ram immediately ascends to the upper position.

It will be seen therefore that applicant has provided an important safety advance for metal forming machines.

I claim:

1. Apparatus for forming material comprising:

a frame,
a bed carried by said frame,
a first die carried by said bed,
a head carried by said frame,
a second die carried by said head,
a fluid actuated cylinder connected between said head on the one hand and said frame on the other hand for relatively moving said bed and said head toward and away from one another between a first position with said dies spaced one from the other for receiving material to be formed therebetween and a second position with said dies in close proximity one to the other with the material formed therebetween,
a source of fluid under pressure, means for selectively supplying fluid under pressure from said source to said cylinder,
a sump,
means for sensing an obstruction between said dies other than the material to be formed and providing a signal in response thereto, and
means responsive to said signal and arranged in controlling relation to said moving means and including a valve operable to selectively divert fluid under pressure from said source to said sump in response to said signal thereby disabling said cylinder from moving said dies toward said second position when an obstruction is disposed between said dies.

2. Apparatus according to claim 1 which further includes means for moving said dies toward said first position thereof in response to disablement of said cylinder.

3. Apparatus for forming material comprising:
a frame,
a bed carried by said frame,
a first die carried by said bed,
a head carried by said frame,
a second die carried by said head,
a fluid actuated cylinder connected between said head and said frame for moving said head toward said bed between a first position with said dies spaced one from the other for receiving material to be formed therebetween and a second position with said dies in close proximity one to the other with the material formed therebetween,
a source of fluid under pressure, means for selectively supplying fluid under pressure from said source to said cylinder,
a sump,
means for sensing an obstruction between said dies other than the material to be formed and providing a signal in response thereto,
means responsive to said signal and arranged in controlling relation to said moving means and including a valve operable to selectively divert fluid under pressure from said source to said sump in response to said signal thereby disabling said cylinder from moving said dies toward said second position when an obstruction is disposed between said dies, and means for returning the head to the first position.

4. Apparatus according to claim 1 or 3 wherein said dies are movable relative to one another through a position intermediate said first and second positions, thereof, and means arranged in controlling relation to said moving means for disabling said preventing means in response to relative movement of said dies through said intermediate position and enabling continued relative movement of said dies from said intermediate position toward said second position.

5. Apparatus for forming material comprising:
a frame,
a bed carried by said frame,
a first die carried by said bed,
a head carried by said frame,
a second die carried by said head,
a pair of fluid actuated cylinders each connected between said head and said frame for moving said head toward said bed between a first position with said dies spaced one from the other for receiving material to be formed therebetween and a second position with said dies in close proximity one to the other with the material formed therebetween,
spring means connected between said head and said frame for normally maintaining the dies in the first position,
a source of fluid under pressure, means for selectively supplying fluid under pressure from said source to said cylinders for moving the head between first and second positions against the force of said spring means,
a sump,
photoelectric means for sensing an obstruction between said dies other than the material to be formed and providing a signal in response thereto, and
means responsive to said signal and arranged in controlling relation to said moving means and including a normally open valve operable to selectively divert fluid under pressure from said source to said sump in response to said signal thereby cutting off flow of pressurized fluid to the cylinders when an obstruction is disposed between said dies so that said spring means return the head to the first position.

* * * * *